US007383654B2

(12) United States Patent
Olivier et al.

(10) Patent No.: US 7,383,654 B2
(45) Date of Patent: Jun. 10, 2008

(54) DOOR HANDLE WITH INTERCHANGEABLE GRAPHIC DISPLAY

(75) Inventors: Archie A. Olivier, Plano, TX (US); William E. Becker, Dallas, TX (US)

(73) Assignee: Exclusive Door Handles, Inc., Dallas, TX (US)

( * ) Notice: Subject to any disclaimer, the term of this patent is extended or adjusted under 35 U.S.C. 154(b) by 0 days.

(21) Appl. No.: 11/233,293

(22) Filed: Sep. 22, 2005

(65) Prior Publication Data

US 2006/0012189 A1 Jan. 19, 2006

Related U.S. Application Data

(63) Continuation of application No. 09/370,133, filed on Aug. 5, 1999, now Pat. No. 6,948,272, which is a continuation-in-part of application No. 09/207,221, filed on Dec. 8, 1998, now abandoned, which is a continuation-in-part of application No. 08/845,861, filed on Apr. 28, 1997, now Pat. No. 6,119,385.

(51) Int. Cl.
*G09F 23/00* (2006.01)

(52) U.S. Cl. ..... 40/661.12; 40/599; 40/611.01; 40/331

(58) Field of Classification Search ..... 40/661.12, 40/599, 611.01, 331; 16/412–414, 903, 111.1
See application file for complete search history.

(56) References Cited

U.S. PATENT DOCUMENTS

| | | | | |
|---|---|---|---|---|
| 190,068 A | | 4/1877 | Odenbaugh | 40/779 |
| 1,826,671 A | | 10/1931 | Ohnstrand | 40/325 |
| 2,796,627 A | * | 6/1957 | Heyer | 16/417 |
| 2,931,078 A | | 4/1960 | Beyrle | 16/111 R |
| 3,008,253 A | | 11/1961 | Bell, Jr. | 40/661.12 |
| 4,862,642 A | | 9/1989 | Alessi | |
| 5,355,554 A | | 10/1994 | Magoon | |
| 5,810,372 A | | 9/1998 | Arendt | |
| 2007/0094905 A1 | * | 5/2007 | Thompson | 040/599 |

FOREIGN PATENT DOCUMENTS

| | | |
|---|---|---|
| EP | 0713819 | 5/1996 |
| GB | 176590 | 3/1922 |
| GB | 1018163 | 6/1966 |
| GB | 2131290 | 6/1984 |

* cited by examiner

*Primary Examiner*—Cassandra Davis
(74) *Attorney, Agent, or Firm*—David H. Judson

(57) ABSTRACT

Apparatus and method for providing a door handle adapted to receive interchangeable display inserts. The door handle includes a handle body adapted to be coupled to a door of an enclosure. A receiving space is provided within the handle body for exchangeably receiving a display insert. A protective front facing planar member is located at a front face of the door handle and a graphic display is positioned behind the protective front facing planar member. The graphic display is visible through the protective front facing planar member by a person upon approach to the door handle.

5 Claims, 14 Drawing Sheets

DOOR HANDLE WITH INTERCHANGEABLE GRAPHIC DISPLAY

RELATED PATENT APPLICATIONS

This application is a continuation of U.S. Ser. No. 09/370,133, filed Aug. 5, 1999 now U.S. Pat. No. 6,948,272, which application was a continuation-in-part of U.S. Ser. No. 09/207,221, filed Dec. 8, 1998 now abandoned, which application was a continuation-in-part of U.S. Ser. No. 08/845,861, filed Apr. 28, 1997 now U.S. Pat. No. 6,119,385.

DESCRIPTION

Technical Field

The present invention relates generally to attachments for doors and in particular to door handles configured to accommodate interchangeable graphic displays.

BACKGROUND OF THE INVENTION

In commercial settings, door pulls and push bars that are mounted on entrance and exit doors of commercial buildings are generally appreciated exclusively for their functional characteristics as they relate to opening doors which are generally biased to a closed position. Predominately, such doors are hinged for pivotation and are swung out of the way be a person desiring to pass therethrough. The conventional design for door pulls and push bars utilized on these door types are generally well known. In the instance of door pulls, an angled structure is usually employed having a free edge easily grasped by the user. A door pull is typically positioned on the side of a door that is pulled toward the user for opening. The location of the door pull is several feet above ground level at a location that is easily graspable by a majority of the public. Often, the door pull has a vertically measured height that is greater than its horizontally measured width.

A push bar is often positioned on the opposite side of a door to a door pull. In many instances, especially in commercial settings, entrance and exit doors are arranged to open outwardly from the building's interior. This is a safety feature that helps assure that the door will open if rushed in an emergency situation from the inside. In keeping with this feature, push bars are often incorporated into a latching mechanism that upon actuation by a push pressure upon the push bar, a door latch is disengaged thereby allowing a previously latched door to be opened by a continued push force by the user. Like the door pull, the push bar is normally located on a door at a height easily embraced by an approaching user. Contrary to the door pull's design, however, the push bar generally has a width that substantially spans the door's width and resultingly has a horizontally measured length greater than its vertically measured height.

To improve the appearance of a business establishment, door handles and push pads are sometimes ornately designed. Rarely, however, are these devices customized for a particular business by incorporating a company logo or other signage into the handle or push pad. Furthermore, those occasional prior attempts to do so have produced less than satisfactory results. Specifically, door handles having a metal exterior surface shaped to incorporate a company logo and painted to correspond to the company's color scheme are known. Not only are such door handles exceedingly expensive to manufacture, repeated use of the door handle often causes the painted exterior surface to quickly appear worn, resulting in added costs if frequently needed touch-ups are applied.

While conventional designs and orientations for door pulls and push bars have considered their positioning and configuration for facilitating engagement by the user, the visual attention that each of these two structures typically receives has been overlooked. Each time a person enters or exits a building, they, either consciously or unconsciously, make a visual fix on the door handle for engagement purposes, regardless of whether the handle takes the form of a door pull or push bar. That means, that even if just for a split second, not only is the person glancing at the door handle, but they are also concentrating on it. Given that many commercial buildings, and especially retail establishments, experience high customer traffic into and out of the building, the pull handles and push bars on the doors to the same are frequently viewed. Heretofore, the highly visible nature of these door handles has infrequently been commercially exploited, and has not been utilized for exchangeable print advertisement. Moreover, there have been no designs for such door handles that accommodate easy exchange of visual displays and permit the handle to remain installed upon the door during the exchange process.

In view of the above described deficiencies associated with known commercial designs for door handles, the present invention has been developed to alleviate these drawbacks and provide further benefits to the user. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed commercial door handles and incorporates several additionally beneficial features that enhance their attractiveness to the relevant end user.

The door pulls and push bars designed according to the present invention capitalizes on the high-visibility characteristics of door handles in a commercial sense that has yet to be exploited. As explained above, door pulls and push bars on commercial doors, and especially those to retail establishments, receive a great deal of attention from consumers as they enter and exit a building. The present invention takes advantage of the frequency at which these door handles are viewed by the public for advertising purposes.

The door handles of this invention have enjoyed a progressive development beginning with an initial door handle construction in which a permanent advertising piece is permanently fixed within or upon the body of the door pull or push bar. Through the development process, however, it has been appreciated that the ability to accommodate an exchangeable display insert provides multiple benefits. These benefits run not only to end users such as retailers who can promote various products and services to each person entering their establishment, but also to the supplier of the handles who can further exploit the advertising aspects of the invention through the continuing service required for manufacture and distribution of an array of advertising inserts which may be as simple as exchangeable self-adhesive stickers. Still further, the distributor of the advertising inserts can additionally sell advertising to particular entities desiring to have their products or services promoted through the channels of the retail utilizers of the door handles. For example, a seller of soft drinks would very much desire to have their product being the last impression made on a consumer entering a convenience store. Door pulls and push bars constructed and utilized according to the present invention provide this ability for a product or service provider to make their product or service the last thing on a purchaser's mind immediately before making a buying decision.

Not only are handles manufactured according to the teachings of the present invention configured to accept print advertisement for display toward an approaching person, but they are further enhanced by a construction that permits the easy exchange of different advertising pieces. This exchange of print advertisement may be accomplished in various ways and remain within the scope of the present invention. A preferred embodiment, however, which is illustrated in at least FIGS. 4 through 7 utilizes a three-part insert combination for creating the visual display that is to be presented to person's approaching the door handles. It is possible, however, that a similar visual presentation may be accomplished using a monolithic insert properly constructed to make an appropriate advertising display. One of the benefits of using the three-part insert is the ability to use different materials for the construction of each sheet or layer. The forward and covering sheet that is exposed at the front face of the door handle can be made of a sufficiently durable material such as that sold under the trademark LEXAN by the General Electric Company. Normally, the front sheet will be transparent for permitting visibility therethrough. The intermediate sheet is constructed so that it advantageously accepts or includes a graphic design to be displayed. Lastly, the third and back sheet is utilized as a contrasting background behind the intermediate sheet for enhancing the desired display presentation.

When provided in the above described three-part assembly, the intermediate graphic display sheet can be readily exchanged for the purpose of easily presenting different appearances to approaching persons. In a most commercial of aspects, this graphic will be an exchangeable advertisement piece that can be distributed easily to an end user who exchanges the new intermediate sheet for that presently located in the door handle assembly. In this manner, advertising inserts can be easily, inexpensively and frequently distributed to the end user of the handle. It is also in this way that an entirely new type of advertising service can be offered and the ads be distributed through the channels of utilizers of the commercial door pulls and push bars described and disclosed herein.

It is also contemplated that further nuances may be added to the display handles such as special lighting effects or sound presentations that are either automatically or pressure responsively actuated by an approaching person's presence or the physical pressure exerted upon the door handle during use.

It should be appreciated that the present invention can be varied in construction to be accommodated on different styled doors. For instance, the door pull that is described and illustrated herein may be utilized on an exterior door or a building, but it can be equally effectively utilized on a commercial interior door such as that to a refrigeration cooler in a convenience store setting. Normally, however, such a cooler door pull will have a width less than that of the exterior door pull because user leverage requirements are typically commensurately reduced. Still further, the general characteristics described with respect to commercial exterior door pulls are equally applicable to the cooler door pull configurations and the push bar configurations of the door handles of the present invention.

In one embodiment, the present invention takes the form of a door handle that is adapted to receive interchangeable display inserts. The door handle includes a handle body that is adapted to be coupled, that is attached, to a door of an enclosure. Normally, the door handle will have a graspable portion that is positioned at a spaced-apart distance from the carrying doors near side surface. Examples of such an enclosure include both private and commercial buildings, as well as interior enclosures such as cooler doors, freezer doors, and the like. A receiving space is provided within the handle body, and preferably within the graspable portion, for exchangeably receiving a display insert. A releasable closure mechanism is associated with the receiving space and adapted to be configured between an open configuration in which display inserts may be inserted and removed from the receiving space and a closed configuration in which a display insert is secured within the receiving space.

In another embodiment, the display insert is additionally included that is configured to be removably located within the receiving space for presenting a visual display to a person upon approach to the door handle. In one version, the display insert has at least two substantially planar members that are associated together to fill the receiving space so that they are held substantially stationary when installed in the receiving space. In this version, a protective front facing planar member is located at a front face of the door handle and a graphic display containing intermediate planar member is positioned behind the protective front facing planar member. The intermediate planar member oriented so that a graphic display of the intermediate planar member is visible through the protective front facing planar member by a person upon approach to the door handle. While the insert members are described as planar, it is contemplated that any sheet-type configuration may be utilized.

In a complimentary embodiment, the present invention takes the form of a method for accommodating interchangeable display inserts in a door handle. The method includes providing a door handle that has a handle body attached to a hinged door of a commercial enclosure. The handle body includes a receiving space therein, preferably in a graspable portion, for exchangeably receiving a removable display insert. To achieve a display configuration, a removable display insert is installed in the receiving space for temporary display to persons approaching the door handle. For varying the display, accommodation for exchanging the removable display insert with a replacement display insert is provided for presenting an alternate visual display to persons approaching the door handle. In a preferred embodiment, the manufacturing technique for the handle body is extrusion molding resulting in the handle body being of one-piece construction.

The beneficial effects described above apply generally to the exemplary devices and mechanisms disclosed herein of the door handle. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

DETAILED DESCRIPTION RELATING TO THE EMBODIMENTS OF THE INVENTION SHOWN IN FIGS. 1-9 AND 17

Figure 1:
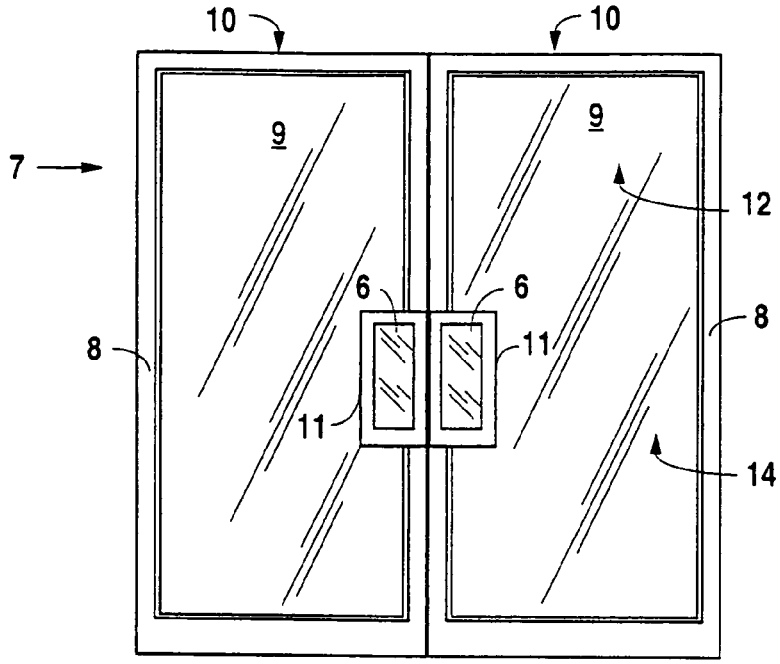
FIG. 1 is an elevational view two side-by-side commercial building access doors, each with door pull handles constructed according to the present invention mounted thereto.
Figure 2:
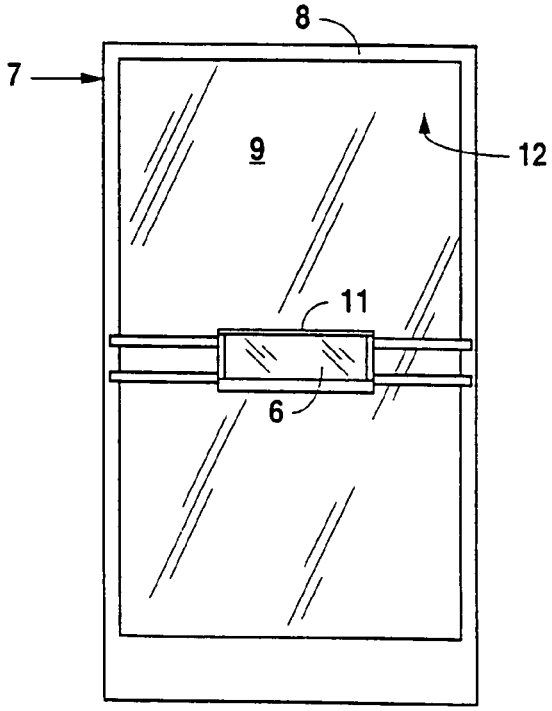
FIG. 2 is an elevational view of a single commercial building access door with a push bar constructed according to the present invention mounted thereto.
Figure 3:
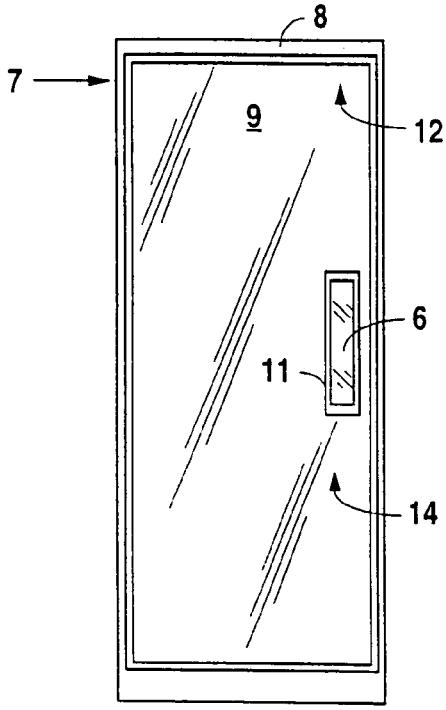
FIG. 3 is an elevational view of a single commercial cooler or freezer door with a more narrow door pull handle than those illustrated in FIG. 1 with respect to access doors mounted thereto.

FIGS. 1-3 illustrates three primary settings or locations at which various embodiments of the present invention may be utilized. FIG. 1 illustrates a door assembly 7 configured as a pair of swinging access doors 10 typically found at commercial and retail establishments. As shown, each door 10 comprises a peripheral door frame 8, typically constructed from metal, surrounding a plate glass or plastic sheet interior section 9. Each door frame 8 is hinged at an outer side edge to the building and the balance of the door 10 is permitted to swing about this hinged edge relative to the building. A door handle or attachment 11 constructed according to the present invention is mounted to each door 10 of the pair, preferably at a location on the frame 8 at the side edge opposite the hinged edge. The door handle 11 is constructed in the form of a door pull in FIG. 1 and is therefore mounted on the pull side 14 of the door 10 proximate the door's 10 forward face 12.

FIG. 2 illustrates a single building access door 10 having a push bar used by an approaching person to push the door open. In an optional configuration of the door 10, the push bar is a component of a pressure actuated latching mechanism for the door 10.

FIG. 3 illustrates a single cooler or freezer door 10 having a door handle 11 constructed according to the teachings of the present invention mounted thereupon. As compared to the handle of the access door illustrated in FIG. 1, the width of the cooler door pull is more narrow, at least in part because of the reduced amount of leverage required to open the smaller and lighter cooler door.

Referring to FIGS. 4-7, a door handle or attachment 11 is shown in the form of a pull handle. Attachment 11 is generally rectangular in shape and has two primary component portions: (1) a graspable portion 18 in which a housing portion 13 is formed and (2) door mounting hardware 17. In the preferred embodiment, these components are formed from extruded metal, preferably aluminum and together the components establish a handle body 16.

Attachment 11 has a backplate 21 and two parallel side members 25, all of which are constructed integrally with one another in that illustrated embodiment. Each side member 25 has a beveled front surface 27 to give housing 13 a smooth finish with rounded corners. A large rectangular forward opening 29 extends interiorly between front surfaces 27. The width of opening 29 is slightly smaller than the width of housing 13 to provide opening 29 with a large area. Opening 29 is partially defined by a pair of inwardly extending flanges or retainer lips 31 along its front side edges. The inner surfaces of lips 31 are flat and parallel to the general orientation of housing 13. Lips 31 have rounded or tapered edges 33 on their front outer surfaces and have a generally consistent thickness and width.

Side members 25 each have a flat inner track or sidewall 41 which are parallel to one another and together partially define a substantially rectangular internal cavity or receiving space 19. Sidewalls 41 extend from lip 31 to a front surface of backplate 21. Backplate 21 has a slightly larger surface area than forward opening 29 as a result of the inwardly projecting retaining lips 31. Backplate 21 also has a threaded aperture or hole 51 located near each of its four corners.

Door attachment 11 has a detachable top cap or closing stop 53 and bottom cap or arresting stop 55 which are substantially identical in shape and size. In the illustrated embodiment, closing stop 53 provides a releasable closure mechanism for securing graphic display 6 within the housing 13. When viewed from above, caps 53 and 55 each have the same cross-sectional profile as the internal receiving space 19 in housing 13. Each cap 53, 55 has a generally rectangularly-shaped elongate body 57 with a long flat rear surface 59, and a front surface 61 that is contoured to the shape of opening 29 and lips 31. The front surfaces 61 each have a pair of notched ends or shoulders 63 on their lateral sides which have flat vertical faces. Rear surface 59 has a pair of threaded blind holes 65 located near shoulders 63. The arresting stop 55 is configured to be secured in a lower open end portion of the receiving space 19, while the closing stop 53 is configured to be secured in the upper open end or access portion 20 of the receiving space 19. The stops 53, 55, together with the retainer lips 31 define a display exposure frame 22 for a graphic display insert 6 when installed within the housing 13.

Figure 5:
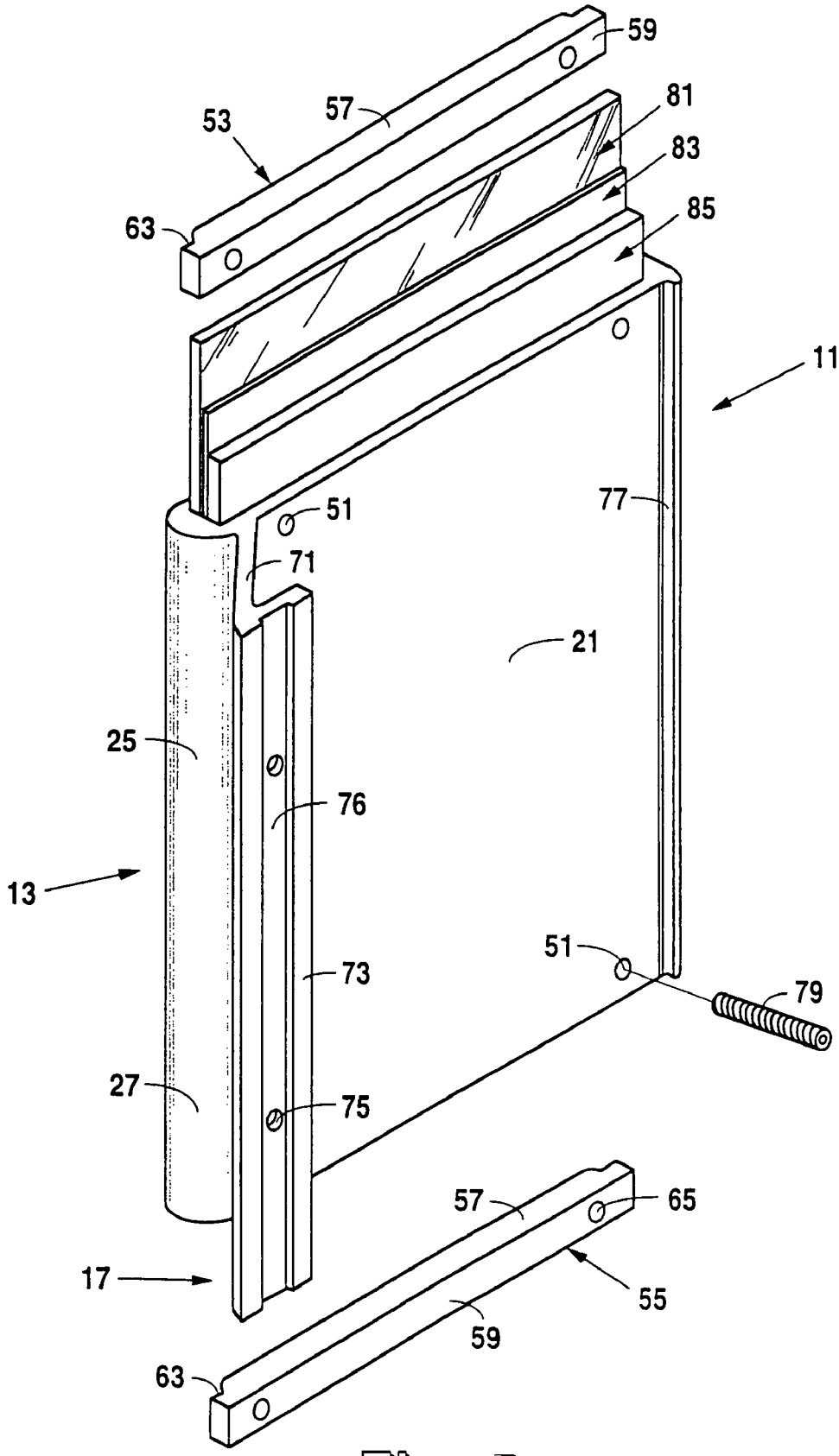
FIG. 5 is a rear exploded view of the door attachment of FIG. 4.
Figure 7:
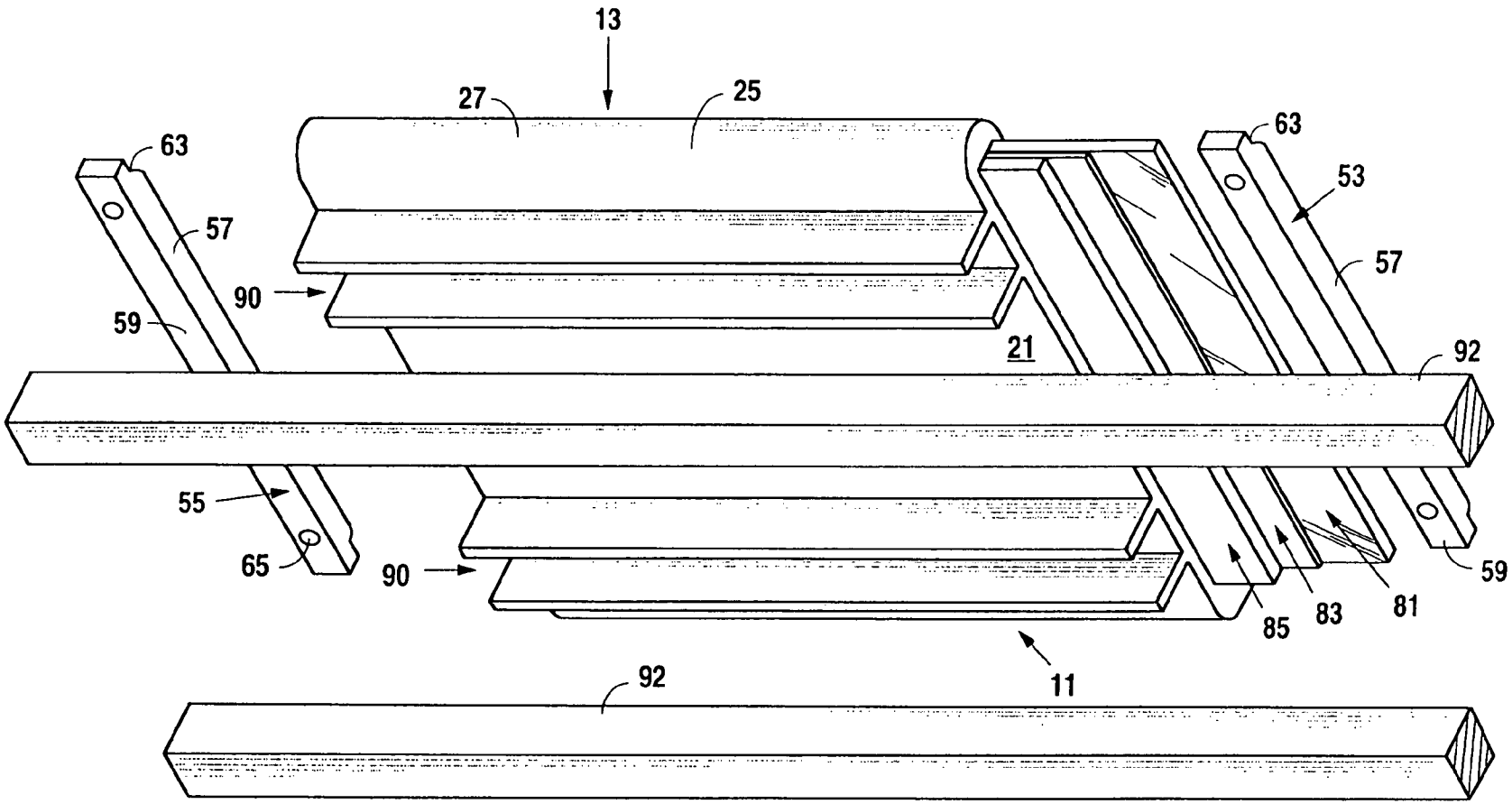
FIG. 7 is a rear exploded view of the door attachment of FIG. 6.

As shown particularly in FIGS. 5 and 7, door mounting hardware 17 is integrally formed with backplate 21 of housing 13. Door mounting hardware 17 in FIG. 5 for a door pull configuration comprises a generally L-shaped protrusion having a stand-off or intermediate portion 71 and a mounting end or securable portion 73. Stand-off 71 protrudes at an angle away from backplate 21. This configuration of the securable portion 73 and intermediate portion 71 establishes a recess 15 between the face of the door and a back side of the graspable portion 18 of the handle assembly 11. It is this recess space 15 that accommodates a user's grasp about the door handle.

A back surface of mounting end 73 is substantially parallel to backplate 21 and has holes 75 for joining mounting hardware 17 to a door in a configuration such as shown in FIGS. 1 and 3. A vertically-oriented ridge or grip 77 is located on the side edge of the back surface of backplate 21 opposite the mounting hardware 17 for resisting slippage of a user's grasp from the handle.

In operation, bottom cap 55 is positioned in the lower end of the receiving space 19 in housing 13 such that its holes 65 align with the bottom two holes 51 in backplate 21. A set screw 79 is threaded into each set of holes 51, 65 to secure bottom cap 55 in place. When bottom cap 55 is so installed, its rear surface 59 abuts backplate 21, its shoulders 63 abut the rearward-facing surfaces of lips 31, and its front surface 61 is substantially flush with opening 29.

Figure 4:
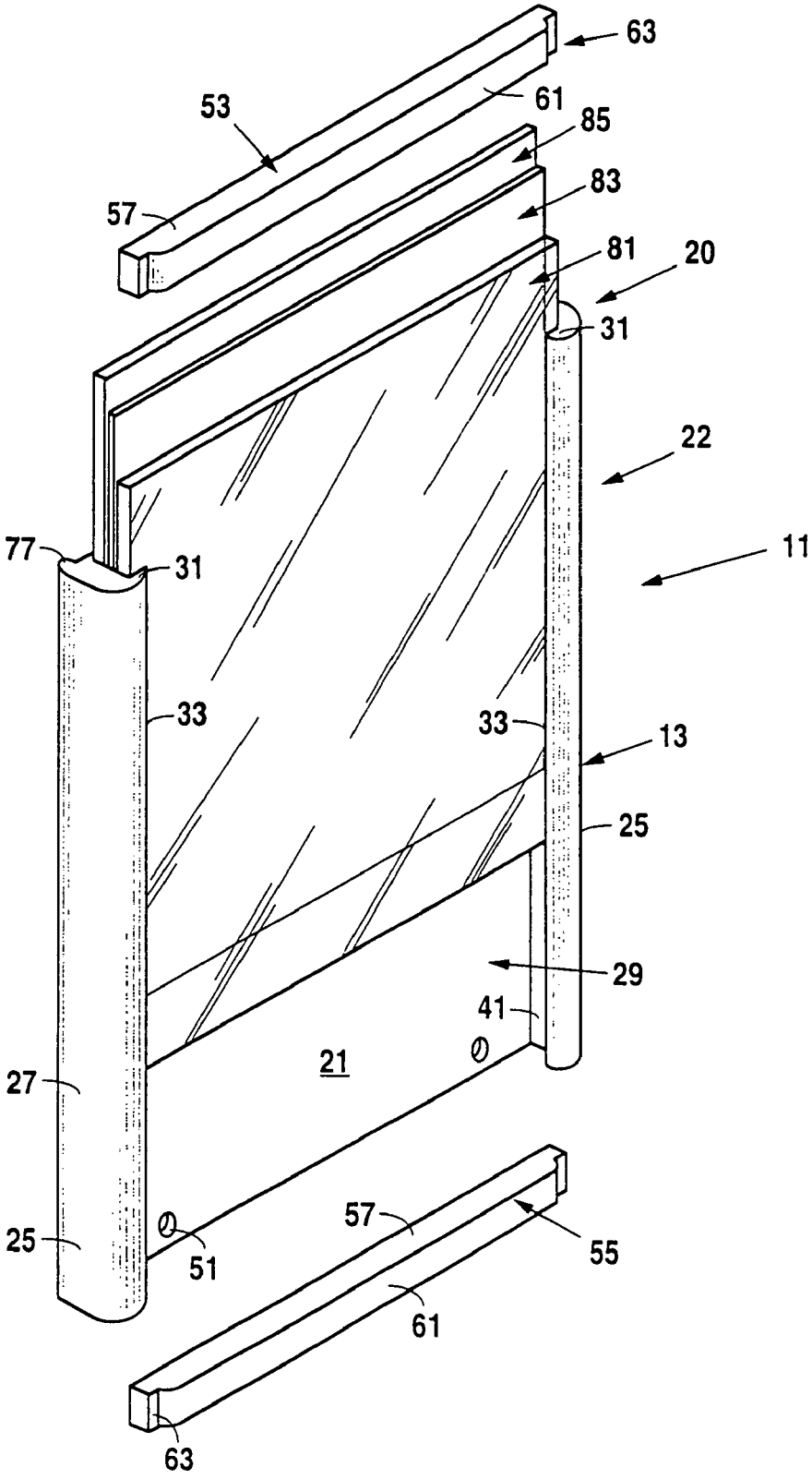
FIG. 4 is a front exploded view of a door attachment constructed in accordance with the present invention. In the vertical orientation shown, the door attachment is utilizable as a door pull, in a horizontal orientation it would be utilizable as a door push bar as illustrated in FIGS. 6 and 7.

Next, a series of rectangular display sheet inserts are placed inside the receiving space 19 in housing 13 on top of bottom cap 55. In the preferred embodiment, from front to back as illustrated in FIG. 4, these inserts comprise a rigid transparent sheet 81, a graphics sheet 83, and an opaque backing sheet 85. Each sheet 81, 83, 85 is slightly less in width than the width of the receiving space 19 in housing 13, and slightly shorter in height than the height of housing 13. Sheets 81, 83, 85 are slidingly guided into the receiving space 19 in housing 13 by tracks 41. It should also be appreciated that the three sheets as described have been found to provide a desirable effect, however, it is also possible to create similar effects using fewer sheets. The three-part configuration though, enables the thinner and less expensive middle graphic sheet 83 to be solely exchanged, while maintaining the "depth" effect produced by the three-sheet configuration. This facilitates the manufacture and shipment of substitute display inserts 6.

Transparent sheet 81 extends across opening 29 and its lateral side edges at its front face 82 abut the rearward-facing surfaces of lips 31. In the embodiment shown, the transparent sheet 81 is approximately ⅛ inch thick and formed from clear plexiglass or other suitably durable sheet material and establishes the predominant surface area of the front face of the graspable portion 18 of the door handle assembly 11. Graphics sheet 83 is placed against sheet 81 so that a graphic illustration depicted, preferably on its forward surface, is visible through the front sheet 81. Sheet 83 is approximately 1/16 inch thick and may be formed from many different materials, including a translucent sheet. Backing sheet 85 is positioned behind and against graphics sheet 83 to press it flat against sheet 81 and remove any remaining space from the receiving space 19 in housing 13. This tight fit prevents rattle between the components. Backing sheet 85 is about ¼ inch thick and may be formed from white plexiglass to help make the translucent graphics sheet 83 more visible. After sheets 81, 83, 85 are in place, top cap 53 is secured at the top of housing 13 in the same manner as bottom cap 55. Caps 53, 55 secure sheets 81, 83, 85 inside housing 13 primarily against vertical movement.

Door attachment 11 may be installed on a door either before or after being assembled as previously described. A common construction for a commercial door frame 8 to which the door attachment 11 is secured includes a ridge that is receivingly accommodated in the recess 76 running along the length of the mounting portion of the attachment 11. Fasteners such as threaded screws insert through holes 75 in mounting ends 73 for securing the door pull to the door frame. The configuration of stand-off 71 establishes a recess or space between the door and backplate 21 into which a user's fingers or hand may be inserted to grip housing 13 for pulling the door open. Top cap 53 may be disengaged from the handle body to remove and/or replace the graphics sheet 83 with another graphics sheet. When the new graphics sheet is in place, top cap 53 is resecured to the housing 13. This sequence of steps may be repeated as often as necessary. The door attachment 11 need not be removed from the door in order to perform this interchangeable feature.

Figure 6:
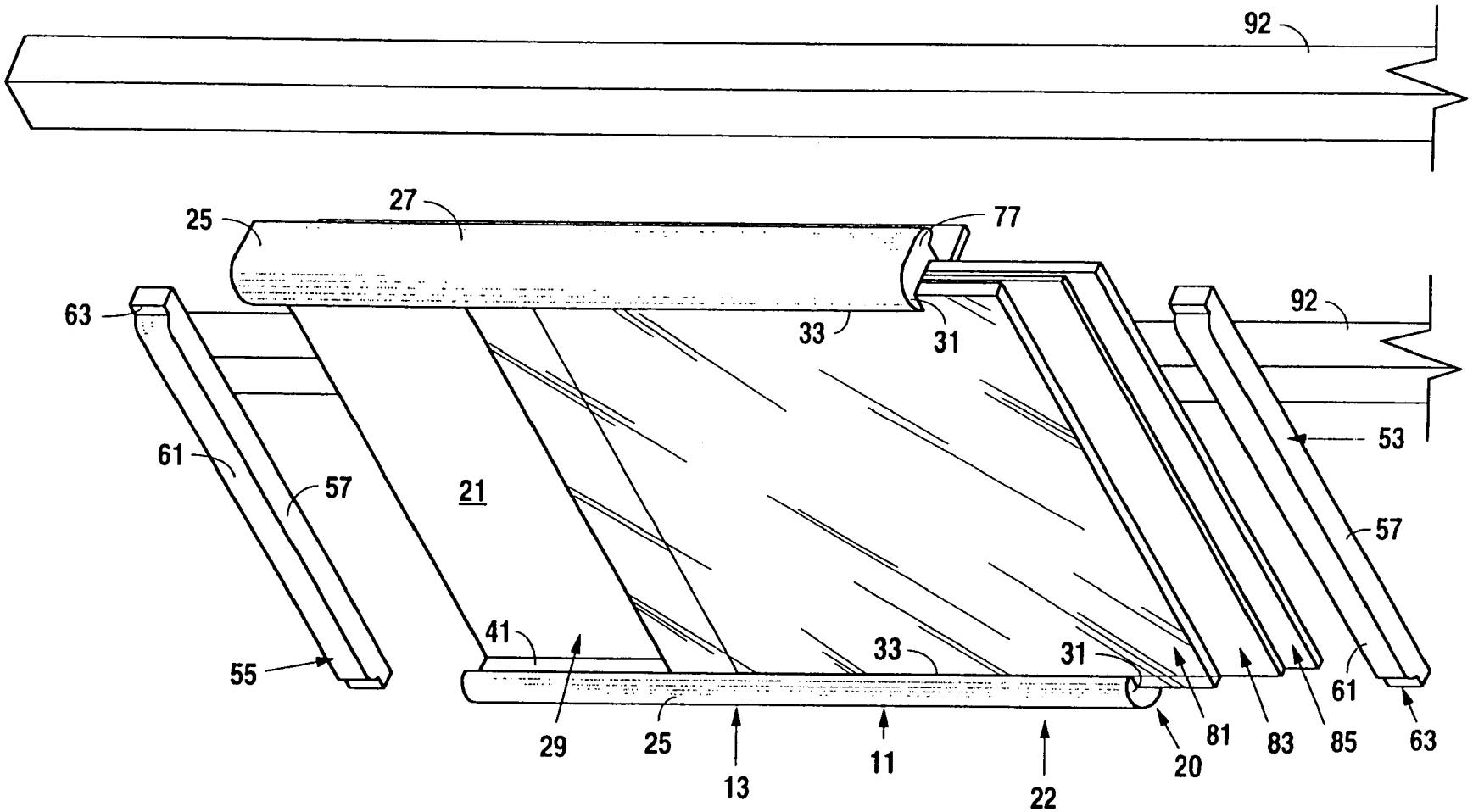
FIG. 6 is a front exploded view of a door attachment constructed in accordance with the present invention in the form of a door push bar assembly.

FIGS. 4 and 5 disclose embodiments of the door attachment 11 in a door pull configuration being elongately constructed in the vertical dimension, while FIGS. 6 and 7 disclose embodiments of the door attachment 11 in a push bar configuration in which the long dimension is horizontally oriented. The component parts of the two assemblies are essentially identical, however, accept for the portions which affect attachment to the door. In the case of the push bar pads of FIGS. 6 and 7, horizontally running receiving angles 90 are included at the back side of the assembly for mating engagement with similarly configured bars 92 which are typically part of the door latch assembly coupled to the door frame. Any suitable mechanism may be employed for securing the angles 90 to the bars 92 such as threaded bolts through apertures, clamps or securement straps.

Figure 8:
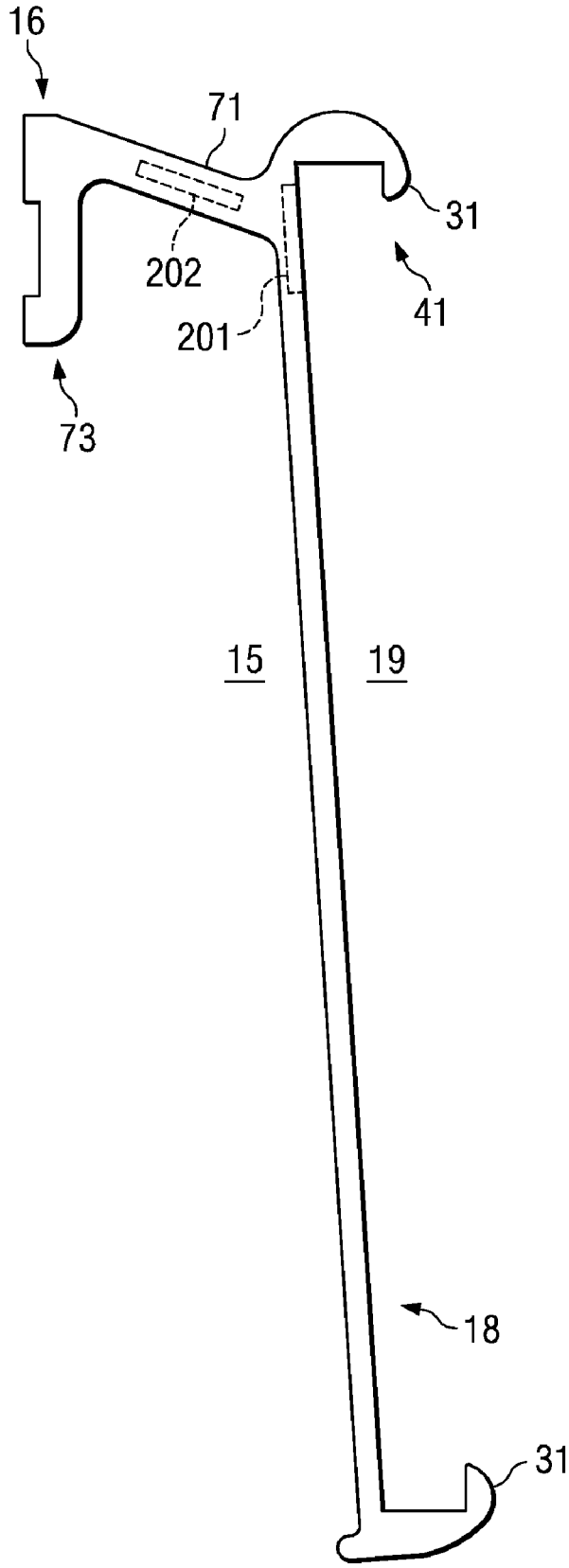
FIG. 8 is a top plan view of a door pull body.
Figure 9:
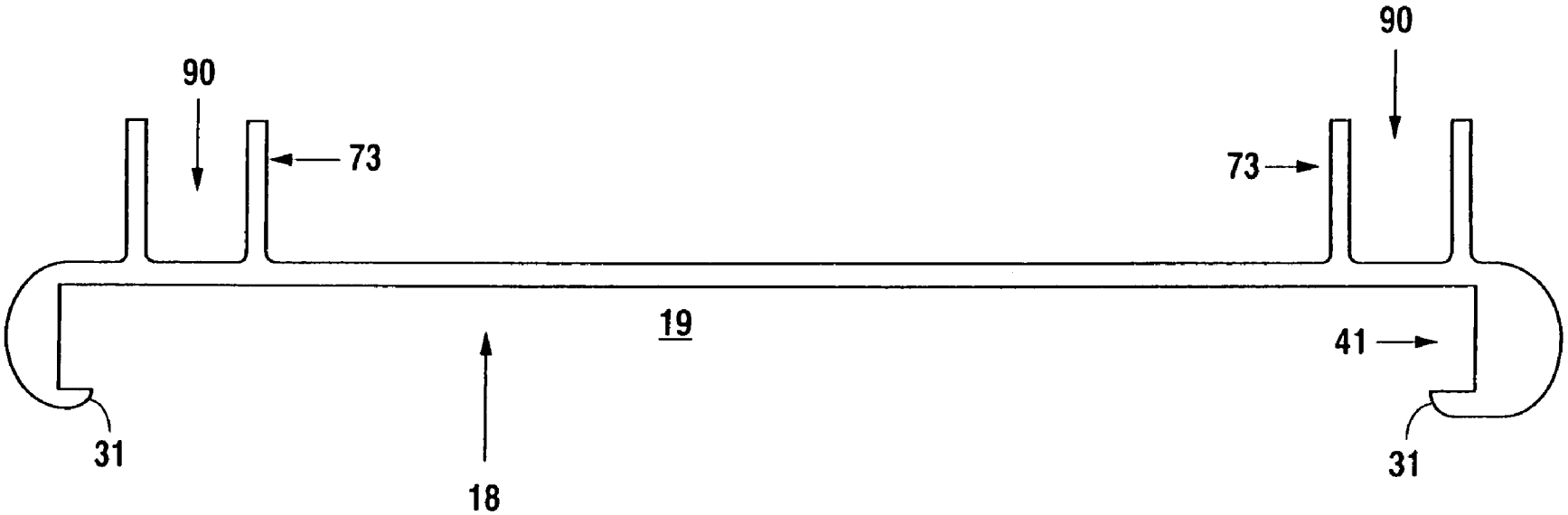
FIG. 9 is an end elevational view of a push bar body.
Figure 17:
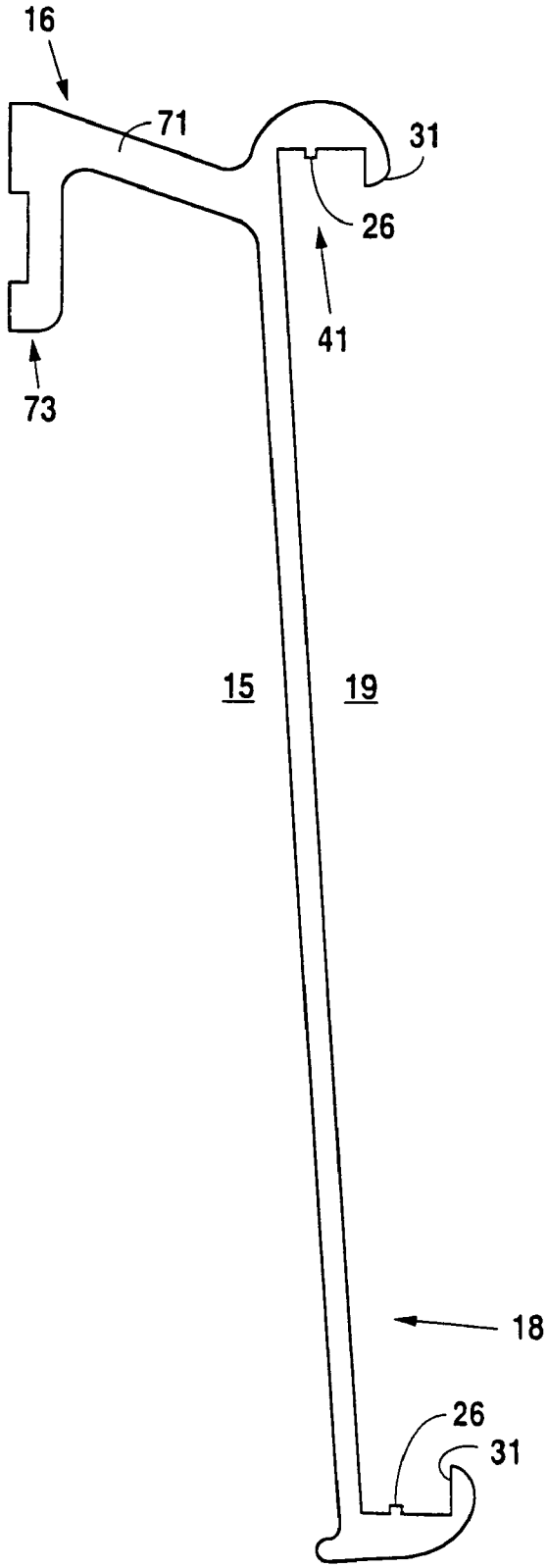
FIG. 17 is a top plan view of a door pull body similar to that shown in FIG. 8, and also including a spacing ridge or projection for separating different layers of a multi-layer display insert.
Figure 18:
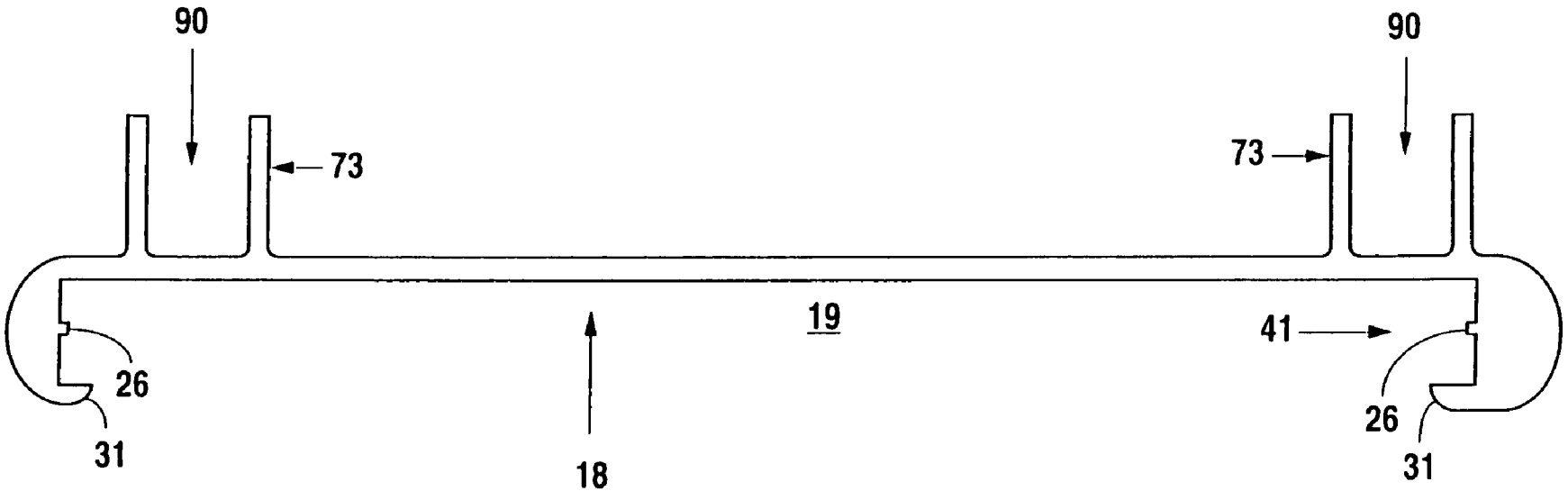
FIG. 18 is a side elevational view of a push bar body similar to that shown in FIG. 9, and also including a spacing ridge or projection for separating different layers of a multi-layer display insert.

FIGS. 8, 9 and 17 show cross-sectional profiles of the handle bodies of the attachment 11. FIG. 8 illustrates the monolithic structure obtained from the extrusion process for the door pull embodiment of the attachment 11. FIG. 17 shows the configuration of FIG. 8, with a slight modification that incorporates an inwardly directed spacer projection 26 that is interstitially located between layers of the insert. The air space created between layers of the insert by the projections 26 permits drying of any moisture that comes between the two separated and adjacent layers thereby avoiding distortion of the desired display presentation that would result if water or other moisture were permitted to remain for extended periods. FIG. 9 shows a cross-sectional profile of the handle body in a push bar or push pad configuration depicted in FIGS. 6 and 7.

DETAILED DESCRIPTION RELATING TO THE EMBODIMENTS OF THE INVENTION SHOWN IN FIGS. 10-14

As may be appreciated from a comparison of the Figures, the embodiments disclosed and shown in FIGS. 10-14 have many similarities to those described above with respect to FIGS. 4-9. The door is described in greater detail as including a first edge, a top edge, a second edge and a bottom edge The first edge is pivotally attached to a building while the top, second and bottom edges are unattached. Fixedly mounted to a front side surface of each door is a door attachment 11*a*. While the door attachment 11*a* disclosed is a door handle, it should be understood that the terms "handle" and "attachment" encompass a wide variety of types of door attachments, including push pads and the like. Furthermore, while the attachment 11*a* is shown mounted on the door, it should be understood that the attachment is equally suitable for mounting on surfaces other than those described herein. Also, while a suitable graphic design (as illustrated in FIGS. 1-3 as graphic display 6) may include any artistic rendering, for most commercial establishments, the business name, logo and/or visual design which enjoys an association with the commercial establishment may be preferred. As is suggested herein, however, great value can also be derived from promotional graphics and advertisements displayed in the suggested manner. Furthermore, while the graphic design may include black or another color or colors of print on a transparent, white or other opaquely colored background, color combinations associated with the commercial establishment are generally preferred.

The door attachment 11*a* is mounted in proximity to the second or free edge of the door so that the door may be readily pivoted into an open position by grasping and pulling the door attachment 11*a*. The door attachment 11*a* should also be positioned sufficiently above the bottom edge of the door so that it may be grasped with ease. For example, positioning the door attachment 11*a* about six inches from the second edge or free edge of the door opposite the hinges and about three feet above the bottom edge of the door should be suitable for the uses contemplated herein. Based on a variety of factors (such as the design of a building's exterior, the graphic design to be displayed thereby and the intended use thereof), the door attachment 11*a* may be variously dimensioned. It is contemplated that a height of about ten and one-half inches and a width of about seven and one-half inches will be suitable for many of both the handle and push pad-type door attachments. It should be noted, however, that some business logos are better suited for door attachments having dimensions and shapes other than those specifically described herein. It should be further noted that some commercial establishments prefer door-width handles and push pads which are typically sized to have a height of about six (6) inches and a width of about twenty-four (24) inches.

Figure 10:
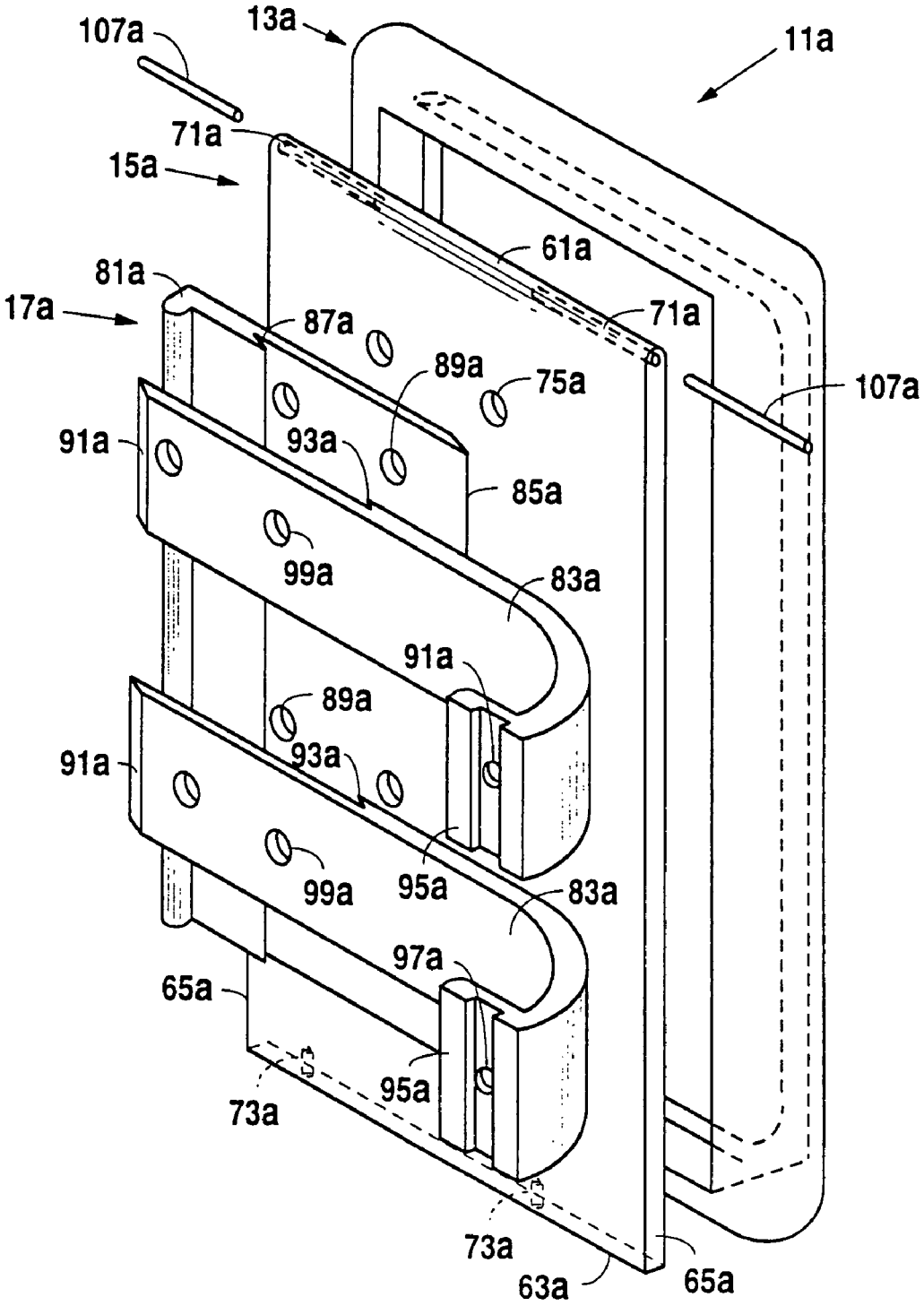
FIG. 10 is a rear exploded view of an alternative embodiment of a door attachment constructed according to the present invention.

Referring to FIG. 10, one embodiment of the door handle or attachment 11*a* is shown. Attachment 11*a* is generally rectangular in shape and comprises three primary components: a frame or housing 13*a*, a backplate 15*a*, and door mounting hardware 17*a*. In a preferred embodiment, these components are formed from aluminum.

Figure 12:
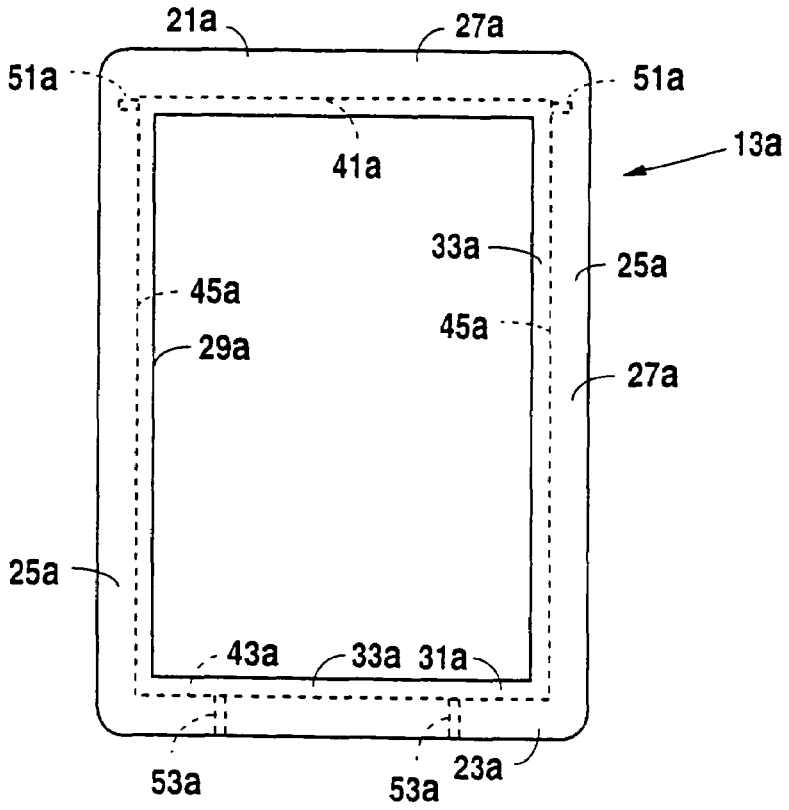
FIG. 12 is a front view of a housing portion of the door attachment of FIG. 10.
Figure 13:
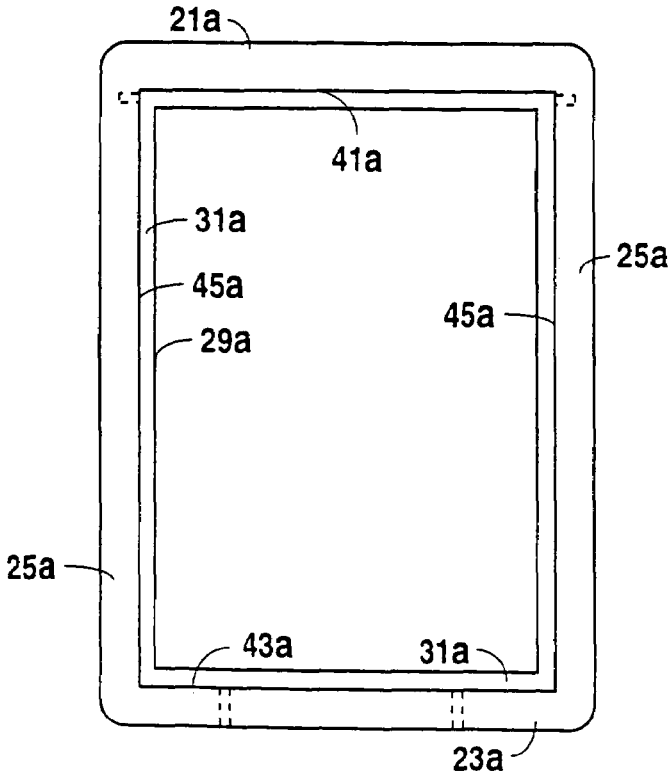
FIG. 13 is a rear view of the housing portion of FIG. 12.
Figure 14:
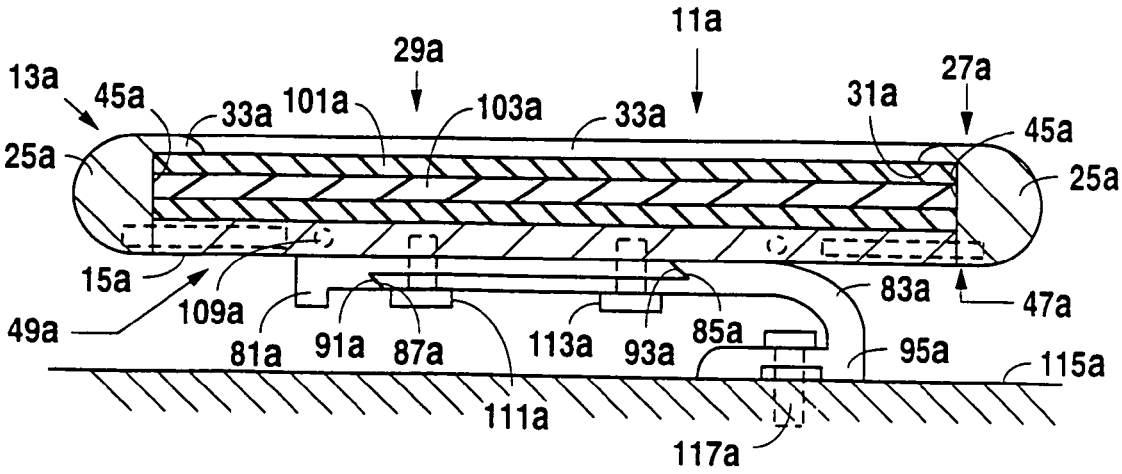
FIG. 14 is a partial horizontal cross-sectional view of the door attachment of FIG. 10.

As shown in FIGS. 12 and 13, housing 13*a* has a top member 21*a*, a bottom member 23*a*, and two side members 25*a*, all of which are integrally constructed with one another. Members 21*a*, 23*a*, 25*a* form a smooth, flush front surface 27*a* on housing 13*a*, and are beveled along their external surfaces to give housing 13*a* a smooth finish with rounded corners. A large rectangular forward opening 29*a* extends through front surface 27*a* of housing 13*a* between members 21*a*, 23*a*, 25*a*. The dimensions of opening 29*a* are slightly smaller than the overall dimensions of housing 13*a* to provide opening 29*a* with a large area. Opening 29*a* defines a thin flange or lip 31*a* along its perimeter. The inner surface of lip 31*a* is flat and parallel to the general orientation of housing 13*a*. Lip 31*a* has a rounded or tapered edge 33*a* on its front outer surface and has a generally consistent thickness and width about its perimeter.

Members 21*a*, 23*a*, 25*a* each have a flat inner sidewall 41*a*, 43*a*, 45*a*, respectively, which are orthogonal to one another and define a rectangular cavity. Sidewalls 41*a*, 43*a*, 45*a* extend from lip 31*a* to a rectangular rearward opening 49*a* at the rearward surface 47*a* of housing 13*a*. Like forward opening 29*a*, the dimensions of rearward opening 49*a* are slightly smaller than the overall dimensions of housing 13*a*. Rearward opening 49*a*, however, is slightly larger than forward opening 29*a* to provide rearward opening 49*a* with a larger area than forward opening 29*a*.

Each side member 25*a* has a blind hole 51*a* extending outward from its sidewall 45*a*. Blind holes 51*a* are located adjacent to top member 21*a* near rearward opening 49*a*. Blind holes 51*a* are coaxial with one another and have shallow depths which do not penetrate side members 25*a*. Bottom member 23*a* has a pair of parallel through holes 53*a* which extend from its exterior to sidewall 43*a*. Holes 53*a* are located near rearward opening 49*a* or approximately symmetric about a midpoint of bottom member 23*a*.

Referring back to FIG. 10, backplate 15*a* is generally flat and rectangular, and has a thickness which is slightly greater than a thickness of lip 31*a*. Backplate 15*a* has a rounded top edge 61*a*, and square bottom and side edges 63*a*, 65*a*, respectively. Each side edge 65*a* has a blind hole 71*a* which extends inward adjacent to top edge 61*a*. Blind holes 71*a* are coaxial with one another and have shallow depths which do not completely penetrate backplate 15*a*. Bottom edge 63*a* has a pair of parallel blind holes 73*a* which extend upward into backplate 15*a*. Blind holes 53*a* are approximately symmetric about a midpoint of bottom edge 63*a*. Backplate 15*a* also has a plurality of mounting holes 75*a* which extend completely through it from its front to back surfaces.

Door mounting hardware 17*a* comprises three components: a mounting platform 81*a* and a pair of identical mounting brackets 83*a*. Mounting platform 81*a* is generally flat and rectangular, and has a sharp, wedge-shaped edge 85*a* on one end. Platform 81*a* also has a sharp, wedge-shaped recess 87*a* on a rearward surface located near an opposite edge. Recess 87*a* is parallel to edge 85*a*. Platform 81*a* also has a plurality of mounting holes 89*a* which extend through it.

Each mounting bracket 83*a* is a generally J-shaped member with a sharp, wedge-shaped edge 91*a* on one end. Brackets 83*a* have a sharp, wedge-shaped recess 93*a* on their forward surfaces located near their midpoints. Recess 93*a* is parallel to edge 91*a*. Each bracket 83*a* also has a substantially flat mounting end 95*a* located opposite of its edge 91*a*. Mounting ends 95*a* are essentially parallel to the linear portions of brackets 83*a* and have at least one mounting through hole 97*a*. Finally, each bracket 83*a* also has a plurality of mounting holes 99*a* which extend through their linear portions.

In operation, a rectangular transparent sheet 101*a* is inserted into rearward opening 49*a* and laid flush against the flat surface of lip 31*a*. Sheet 101*a* may be formed from rigid plastic or plexiglass, and is approximately the same size as rearward opening 49*a*. A graphics sheet 103*a* is placed against sheet 101*a* so that a graphic illustration depicted on its forward surface is visible through sheet 101*a*. Next, a rigid backing 105*a* is placed against graphics sheet 103*a* to press it flat against sheet 101*a*. Graphics sheet 103*a* and backing 105*a* are approximately the same size as sheet 101*a*.

With sheets 101*a*, 103*a* and backing 105*a* in place in housing 13*a*, backplate 15*a* may be installed on housing 13*a*. Alternatively, backplate 15*a* may be installed on housing 13*a* prior to the installation of sheets 101*a*, 103*a* and backing 105*a*. In either sequence, backplate 15*a* is joined to housing 13*a* with pins 107*a* which extend between holes 71*a* in backplate 15*a* to holes 51*a* in housing 13*a*. Pins 107*a* allow backplate 15*a* to be pivoted about their axes relative to housing 13*a* between an open position and a closed position. With backplate 15*a* in the closed position, fasteners 109*a* may be used to secure the bottom edge 63*a* to housing 13*a* and prevent backplate 15*a* from moving to the open position. Fasteners 109*a* engage holes 53*a* in housing 13*a* and holes 73*a* in backplate 15*a*.

Mounting hardware 17*a* may be installed on backplate 15*a* either prior to the previously described assembly or after it. Mounting hardware 17*a* is installed by sliding edges 85*a*, 91*a* into recesses 93*a*, 87*a* respectively, so that holes 75*a*, 89*a* and 99*a* coaxially align with one another. Next, fasteners 111*a*, such as the screws 113*a* are used to rigidly fasten mounting hardware 17*a* to backplate 15*a*. Finally, door attachment 11*a* is installed on a door 115*a* with fasteners 117*a* which insert through holes 97*a* in mounting ends 95*a*. This results in a recess or space between door 115*a* and backplate 15*a* into which a user may insert his fingers or hand to grip housing 13*a* and open door 115*a*.

In the event that graphics sheet 103*a* needs to be removed or replaced with another graphics sheet, fasteners 109*a* may be removed to allow door attachment 11*a* to move to the open position. Backing 105*a* should be carefully held in place while moving housing 13*a* upward and outward away from door 115*a* to prevent its contents from falling out. Backing 105*a* can then be removed to remove and/or replace sheet 103*a*. With the new graphics sheet 103*a* in place, backing 105*a* is replaced and housing 13*a* is lowered to the closed position and resecured to backplate 15*a* with fasteners 109*a*. This sequence of steps may be repeated as often as necessary. Door attachment 11*a* need not be removed from door 115*a* in order to perform this interchangeable feature.

Figure 11:
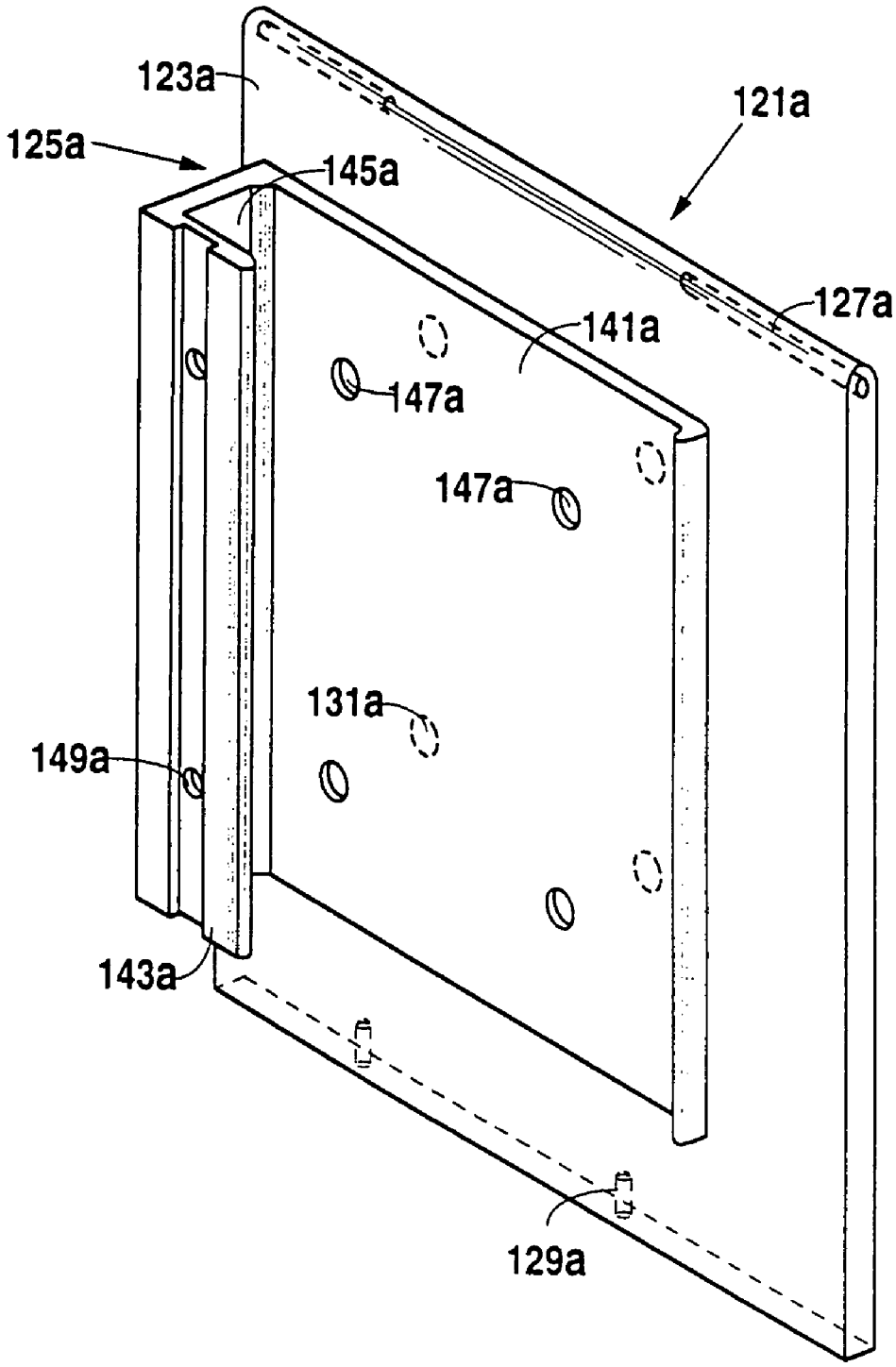
FIG. 11 is a rear view of an additional alternative embodiment of a door attachment constructed according to the present invention.

Referring to FIG. 11, a second embodiment of the invention known as door attachment 121*a* is shown. Like door attachment 11*a*, door attachment 121*a* comprises a housing which is not shown for simplification purposes, a backplate 123*a* and mounting hardware 125*a*. Backplate 123*a* and its housing are virtually identical to backplate 15*a* and housing 13*a*, respectively, except for some slight dimensional variations which are used for illustration purposes. Backplate 123*a* has holes 127*a*, 129*a*, 131*a* which are identical in form and function to holes 71*a*, 73*a*, 75*a* in backplate 15*a*.

Mounting hardware 125*a* differs significantly from mounting hardware 17*a*. Mounting hardware 125*a* comprises a single, L-shaped component having a plate 141*a* and a mounting end 143*a*. A flange 145*a* integrally joins mounting end 143*a* to plate 141*a*. Plate 141*a* has holes 147*a* for joining mounting hardware 125*a* to backplate 123*a*, and mounting end 143*a* has holes 149*a* for joining mounting hardware to a door. In operation, door attachment 121*a* is formed in the same way and functions in the same manner as door attachment 11*a*, except for the way it is attached to the door. Similarly, the user may insert his fingers into the space between the door and backplate 123*a* to grip the housing and open the door.

Regarding the various embodiments of the present invention, that is, those handle apparatus and methods that incorporate exchangeable displays, though each has been described with particular reference to specific constructions thereof, it will be apparent to those skilled in the art that the same principles may be used in similar arrangements. Furthermore, it will be recognized that the invention is not limited to the precise structures described. These and other variations, which will also be appreciated by those skilled in the art, are within the intended scope of this invention as claimed below. As previously stated, detailed embodiments of the present invention are disclosed herein for example purposes; however, it is to be understood that the disclosed embodiments are merely exemplary of the invention that may be embodied in various forms.

Figure 15:
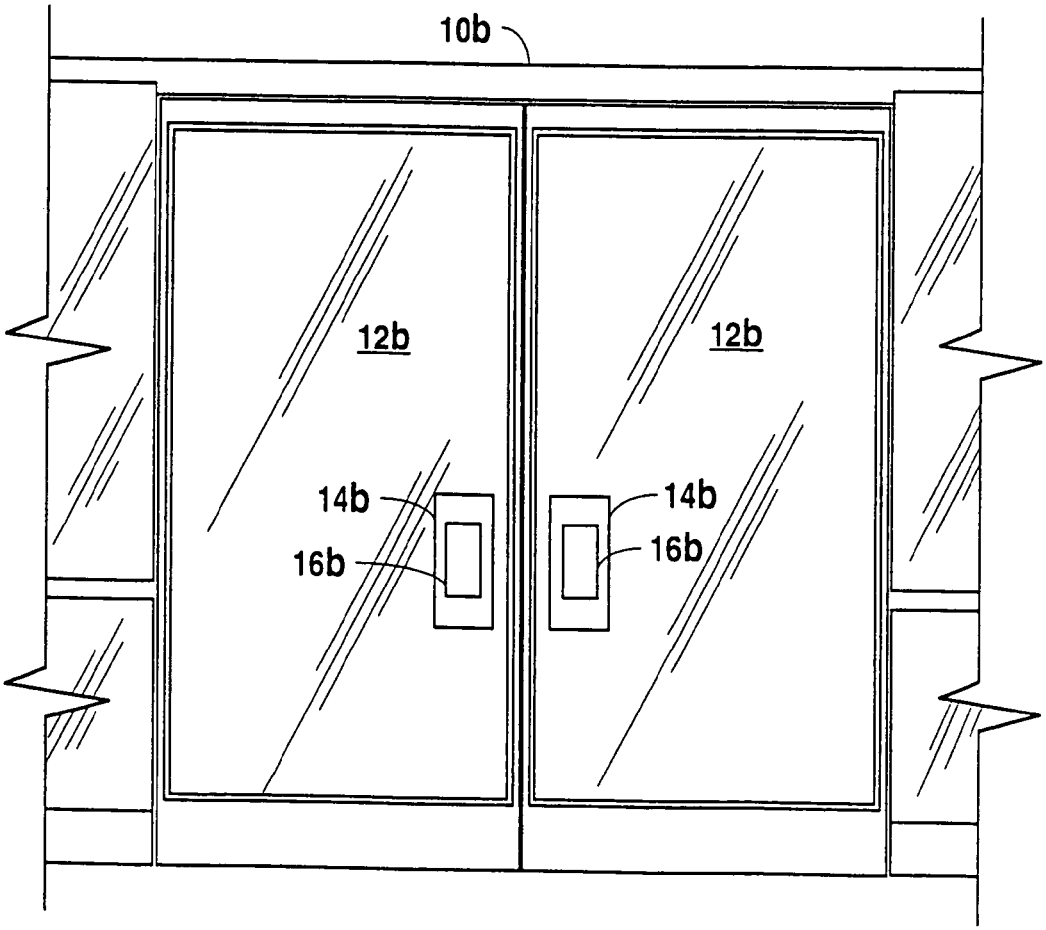
FIG. 15 is a partial front view of a building having a pair of doors to which door handle assemblies are, one each, mounted thereupon.
Figure 16:
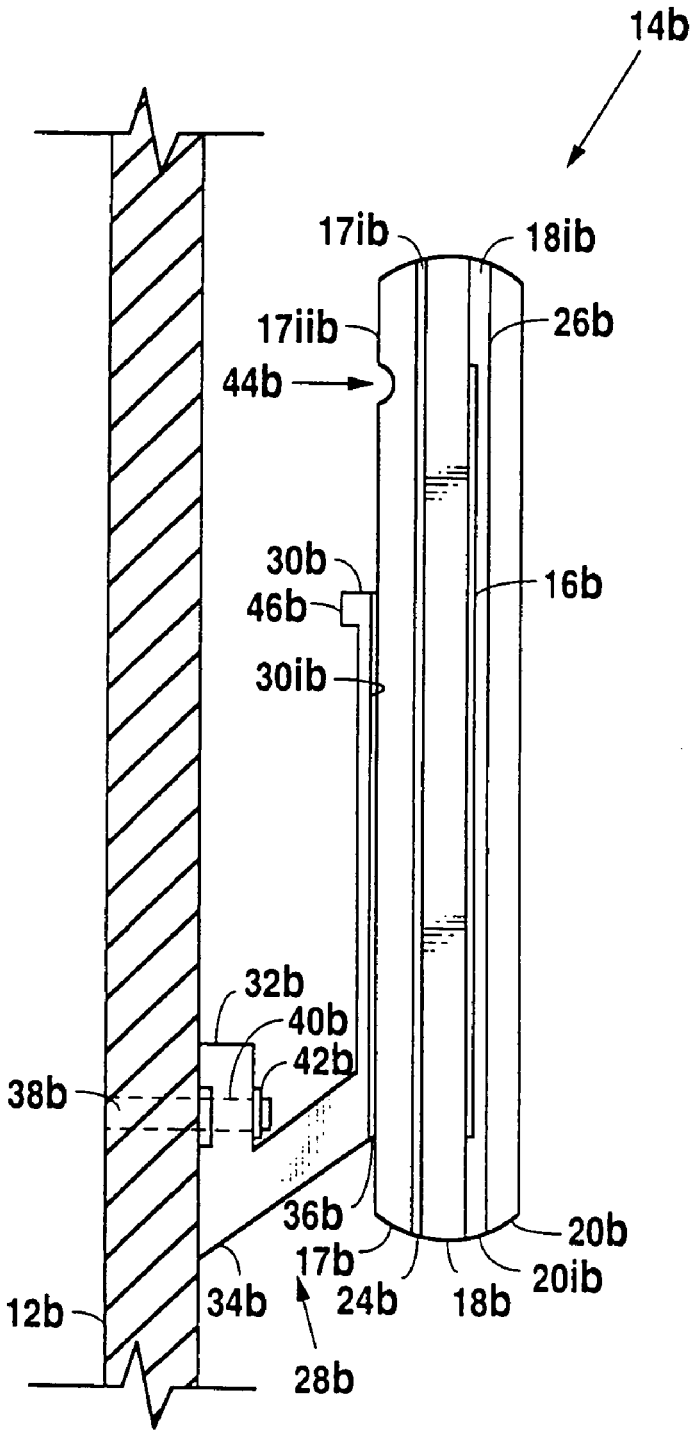
FIG. 16 is a top plan view of one door pull handle of FIG. 15.

DETAILED DESCRIPTION RELATING TO AN EARLY VERSION DOOR HANDLE, SHOWN IN FIGS. 15 AND 16, FROM WHICH THE PRESENT INVENTION DEVELOPED

FIG. 15 illustrates a building 10*b* such as a retail store located in a strip center or other commercial structure which may be entered via either one of a pair of conventionally designed doors 12*b*. Each door 12*b* includes a first edge that is normally hinged to the building 10*b*, and a top edge, a second edge and a bottom edge each of which are free and thereby accommodate swing action of the door between open and closed configurations. Fixedly mounted to a front side surface of each door 12*b* is a door attachment 14*b* constructed in accordance with the present invention to incorporate a readily visible graphic design 16*b*. While the door attachment 14*b* disclosed is a door handle, it should be understood that the terms "handle" and "attachment" encompass a wide variety of types of door attachments, including push pads and the like. Furthermore, while the attachment 14*b* is shown mounted on the door 10*b*, it should be understood that the attachment is equally suitable for mounting on surfaces other than those described herein.

The door attachment 14*b* is mounted in proximity to the second edge opposite the first hinged edge so that the door 12*b* may be readily pivoted into an open position by grasping and pulling the door attachment 14*b*. The door attachment 14*b* should also be positioned sufficiently above the bottom edge of the door so that the door attachment 14*b* may be grasped with ease. For example, positioning the door attachment 14*b* about six inches from the second edge and about three feet above the bottom edge should be suitable for the uses contemplated herein. Based on a variety of factors, such as the design of the building exterior, the graphic design 16*b* to be displayed thereby and the intended use thereof, the door attachment 14*b* may be variously dimensioned. It is contemplated that a height of about ten and one-half inches and a width of about seven and one-half inches will be suitable for many of both the handle and push pad-type door attachments. It should be noted, however, that some business logos are better suited for door attachments having dimensions and shapes other than those specifically described herein. It should be further noted that some commercial establishments prefer door-width handles and push pads which are typically sized to have a height of about six (6) inches and a width of about twenty-four (24) inches.

As shown in FIG. 16, the door attachment 14*b* includes a first (or lower) body portion 17*b*, a second (or main) body portion 18*b* and a third (or upper) body portion 20*b*. In the embodiment illustrated, the main body portion 18*b* and the upper body portion 20*b* are transparent while the lower body portion 17*b* is opaque colored material. It should be understood, however, that a partially opaque or transparent material is equally suitable for use as the lower body portion 17*b* while partially or fully opaque materials may be selected for use as the main body portion 18*b* and some partially opaque materials may even be suitable for use as the upper body portion 20*b*. Of the various possible combinations of transparent, opaque and partially-opaque body portions, the most desirable combination for any given application of the invention will vary based on considerations such as coloration of the graphic display 16*b* and/or existence of any color combinations associated with the subject business establishment. Absent the existence of such a color combination, however, it is contemplated that an opaque white lower body portion 17*b*, in combination with the transparent main and upper body portions 18*b* and 20*b*, will be best suited for most applications.

A graphic display decal 16*b* is fixedly attached to the top side surface 18*ib* of the main body portion 18*b*. It is contemplated that a variety of techniques may be used to affix the graphic display 18*b* to the top side surface 18*ib*. For example, a sheet of adhesive vinyl having a layer of adhesive on a rear side surface thereof and on which the graphic display decal 16*b* has been printed or otherwise formed may be placed on the top side surface 18*ib*. The unprinted portions of the sheet are then pulled away, leaving the graphic display 16*b* mounted on the top side surface 18*ib*. Alternately, the graphic display 16*b* may be imprinted on the top side surface 18*ib*, for example, using a stenciling process or the like. Of course, in this embodiment a front surface of the graphic display 16*b* will have a layer of adhesive. Furthermore, while the embodiment of the invention illustrated employs a graphic display decal 16*b* attached to the top side surface 18*ib* of the main body portion 18*b*, it should be understood that attaching a graphic display 16*b* to other surfaces of the door attachment 14*b* is equally suitable for the purposes contemplated herein. For example, graphic display decal 16*b* may be attached to a bottom side surface 20*ib* of the upper body portion 20*b*. In any event, however, to minimize wear of the graphic display 16*b* it is preferred that the display be a decal 16*b* which is attached to the door attachment 14*b* such that it will be sandwiched between a pair of body portions of the attachment.

In one embodiment, a first sheet of a transparent polyurethane 24*b* is placed between top side surface 17*ib* of the lower body portion 17*b* and bottom side surface 18*iib* of the main body portion 18. A second sheet of transparent polyurethane 26*b* is placed between top side surface 18*ib* of the main body portion 18*b*, including the graphic display decal 16*b*, and bottom side surface 20*ib* of the upper body portion 20*b*. The door attachment 14*b* is then heated to a temperature sufficiently high to melt the sheets of polyurethane and is then vacuum pressed to remove any air bubbles trapped between the top side surface 17*ib* of the lower body portion 17*b* and the bottom side surface 18*iib* of the main body portion 18*b* or between the top side surface 18*ib* of the main body portion 18*b* and the bottom side surface 18*ib* of the upper body portion 20*b*. The door attachment is then cooled to room temperature. By treating the door attachment 14*b* in this manner, the first and second sheets 24*b* and 26*b* of polyurethane melt to fuse, respectively, the top side surface 17*ib* of the lower body portion 17*b* to the bottom side 18*iib* of the main body portion 18*b*, thereby fixedly securing the graphic display decal 16*b* therebetween, and the top side surface 18*ib* of the main body portion 18*b* to the bottom side surface 20*ib* of the top body portion 20*b*.

As described above, the door attachment 14*b* is configured to include an opaque lower body portion 17*b*, a transparent main body portion 18*b*, a transparent upper body portion 20*b* and a graphic display 16*b* fixedly secured between the transparent main body portion 18*b* and the transparent main upper body portion 20*b*. This embodiment is particularly well-suited to serve as a graphic display for a business establishment. Specifically, the graphic display decal 16*b* may be a business logo or other artistic rendering. Since the upper body portion 20*b* is transparent, the graphic display decal 16*b* is readily visible therethrough. The opaque lower body portion 17*b* provides a backdrop against which the graphic display decal 16*b* contrasts, thereby substantially enhancing visibility of the graphic display decal 16*b*. Furthermore, the transparent main body portion 18*b* spaces the graphic display 16*b* from the opaque lower body portion 17*b*, thereby causing the display 16*b* to appear positioned in a foreground relative to the contrasting backdrop created by the opaque lower body portion 17*b*. The transparent main body portion 18*b* further enhances the graphic display by providing a three-dimensional visual perspective.

While the preferred embodiment of the door attachment 14*b* includes lower, main and upper body portions 17*b*, 18*b* and 20*b*, it should be understood that alternate configurations may include various numbers of body portions. For example, a door attachment comprising a graphic display decal fixedly secured between either an opaque or transparent lower body portion and a transparent upper body portion may be suitable for some purposes. Furthermore, while edge side surfaces of the lower, main and upper body portions 17*b*, 18*b* and 20*b* preferably have slightly rounded edges, it is contemplated that the edge surfaces thereof may be formed in a variety of shapes while remaining within the scope of the invention.

As illustrated in FIG. 16, a mounting bracket 28*b* fixedly secures the door attachment 14*b* to door 12*b*. As described herein, the mounting bracket 28*b* is metal. However, other hardened materials may be used to form the mounting bracket 28*b*. Furthermore, while it is preferred that the mounting bracket 28*b* be the same color as the opaque lower body portion 17*b* the mounting bracket 28*b* may be any of a variety of colors. Preferably, the color of the mounting bracket 28*b* is selected to correspond with the color scheme of the graphic display, particularly if the lower body portion 17*b* is transparent.

The mounting bracket 28*b* is preferably comprised of a first section 30*b* which secures the door attachment 14*b* thereto, a second section 32*b* configured for mounting the door attachment 14*b* and an intermediate section 34*b* which couples the first and second sections 30*b* and 32*b*. While the first and second sections 30*b* and 32*b* appear generally parallel with each other in FIG. 16, the first section 30*b* is preferably slightly angled relative to the second section 32*b*.

A layer 36*b* of adhesive material such as epoxy or the like attaches bottom side surface 17*iib* of the lower body portion 17*b* to upper side surface 30*ib* of the first section 30*b* of the mounting bracket 28*b*. The mounting bracket 28*b* is secured to the door 12*b* by a pair of bolts 38*b*, one of which is visible in FIG. 16.

In the illustrated embodiment, a pair of apertures 40*b* are formed in section 32*b* of the mounting bracket 28*b*. Preferably, one of the apertures is formed in proximity with a top edge thereof and the other is formed in proximity with a lower edge. In this configuration, torque applied to the door attachment 14*b* is evenly distributed when transferred to the door 12*b*, greatly reducing the likelihood that the door attachment 14*b* will be inadvertently detached from the door

12*b*. It should be understood, however, that disclosure of a pair of bolts 38*b* and corresponding apertures 40*b* is purely exemplary and that any number of bolts 38*b* may be used to secure the door attachment 14*b* to the door 12*b*. It is preferred, however, that the arrangement of apertures 40*b* in the mounting bracket 28*b* be configured similarly to standard door handles so that existing doors may be readily retrofitted with door attachments constructed in accordance therewith.

For embodiments wherein the door attachment 14*b* operates as a door pull handle, it is contemplated that the door attachment be provided with one or more gripping surfaces to aid usability thereof. As shown in FIG. 16, the door attachment 14*b* is provided with two such gripping surfaces. More specifically, an indentation 44*b* is formed in the bottom side surface 17*iib* of the lower body portion 17*b* to provide a first gripping surface and a projection 46*b* extends outwardly from the first section 30*b* of the mounting bracket 28*b* to provide a second gripping surface. Preferably, the indentation 44*b* extends from top to bottom edge side surfaces of the lower body portion 17*b* while the projection 46*b* extends from top to bottom edge side surfaces of the first section 30*b*.

The door attachment described immediately above provides a suitable graphic display, but is not specifically designed to accommodate exchange of the display. By sandwiching a graphic containing layer between a top side surface of a main body portion and a bottom side surface of a substantially transparent upper body portion which are fused together. In this manner, the graphic display incorporated within the door attachment is both clearly visible and exceedingly wear-resistant. Furthermore, by selecting a transparent main body portion and fusing it to a an opaque lower body portion, a visually dramatic graphic display is formed which appears to be positioned in a foreground of a sharply constrasting backdrop.

As noted above, the door handle of the present invention may include lighting or sound effects. FIG. 8 is illustrative, although these effects may be implemented in any of the door handle embodiments. In this, representative figure, the door handle includes a light source 201, which includes a lighting element such as a LED, light bulb or other illumination element. Any lighting element that illuminates the display graphic may be used. In addition, or in the alternative, the door handle includes a sound source 202, which may include a sound-producing element such as a speaker. Typically, the light source or sound source is self-powered, e.g., through a battery, although any suitable power mechanism may be used. In either case, preferably the light source or sound source, as the case may be, is automatically- or pressure-responsively actuated by an approaching person's presence exerted upon the door handle during use.

What is claimed and is desired to be secured by Letters Patent is as follows:

1. A door handle assembly adapted to receive interchangeable display inserts, comprising:

a handle body adapted to be coupled to a door, the handle body having a securable portion configured for attachment to the door and a graspable portion configured for being grasped, the door handle assembly being configured to position the graspable portion at a distance from a forward face of the door when the door handle assembly is attached thereto; and the graspable portion having a support surface, opposed top and bottom members, and a pair of opposed side members each of which include an inwardly-extending retaining flange thereby forming a receiving space, the receiving space being adapted for exchangeably receiving a display insert, the graspable portion further including a protective, transparent, front-facing member overlying the support surface and adapted to be removably received in the pair of opposed side members by the inwardly-extending retaining flanges;

wherein at least one of the opposed top and bottom members is detachable.

2. The door handle assembly as described in claim 1 further including the display insert located within the receiving space.

3. The door handle assembly as described in claim 2 wherein the graspable portion further includes:

a backing sheet supported within the receiving space and adapted to underlie and support the display insert.

4. The door handle assembly as described in claim 1 further including a light source.

5. The door handle assembly as described in claim 1 further including a sound source.

* * * * *